US009271570B2

(12) United States Patent
Ceballos Godefroy

(10) Patent No.: US 9,271,570 B2
(45) Date of Patent: Mar. 1, 2016

(54) FOLDABLE DISPLAY UNIT

(76) Inventor: Ricardo Ceballos Godefroy, Benito Juárez (MX)

( * ) Notice: Subject to any disclaimer, the term of this patent is extended or adjusted under 35 U.S.C. 154(b) by 0 days.

(21) Appl. No.: 13/818,735

(22) PCT Filed: Aug. 24, 2011

(86) PCT No.: PCT/IB2011/001944

§ 371 (c)(1),
(2), (4) Date: May 6, 2013

(87) PCT Pub. No.: WO2012/025817

PCT Pub. Date: Mar. 1, 2012

(65) Prior Publication Data

US 2013/0221818 A1 Aug. 29, 2013

(30) Foreign Application Priority Data

Aug. 26, 2010 (MX) ..... MX/a/2010/009379

(51) Int. Cl.

| | |
|---|---|
| ***A47B 73/00*** | (2006.01) |
| ***A47F 5/10*** | (2006.01) |
| ***A47F 3/06*** | (2006.01) |
| ***A47B 43/00*** | (2006.01) |

(52) U.S. Cl.
CPC . *A47B 43/00* (2013.01); *A47F 5/10* (2013.01); *A47F 3/06* (2013.01)

(58) Field of Classification Search
CPC ..... A47F 3/004; A47F 3/06; A47F 5/08; A47F 5/10; A47F 5/116; A47B 43/00; A47B 47/00
USPC ..... 312/258, 262, 126, 128, 138.1, 117, 312/351; 108/162, 179
See application file for complete search history.

(56) References Cited

U.S. PATENT DOCUMENTS

| | | | | | |
|---|---|---|---|---|---|
| 175,308 | A * | 3/1876 | Van Wie | ..... | 312/238 |
| 728,673 | A * | 5/1903 | Clay | ..... | 312/262 |
| 988,530 | A * | 4/1911 | Yoakam | ..... | 312/128 |
| 2,375,726 | A * | 5/1945 | Bales | ..... | 108/109 |

(Continued)

FOREIGN PATENT DOCUMENTS

| | | | | |
|---|---|---|---|---|
| WO | 9611604 | A1 | 4/1996 | |
| WO | WO 2008047230 | A1 * | 4/2008 | ..... A47F 5/10 |

(Continued)

OTHER PUBLICATIONS

International Search Report for corresponding application PCT/IB2011/001944 filed Aug. 24, 2011; Mail date Feb. 1, 2012.

*Primary Examiner* — Andrew Roersma
(74) *Attorney, Agent, or Firm* — Cantor Colburn LLP

(57) ABSTRACT

The invention relates to a foldable display unit comprising a lower half supporting an upper half. The lower half includes a lower right wall and a lower left wall, housed therein. The upper half comprises an upper right wall and an upper left wall, housed therein. The walls of the right side are interconnected in a hinged manner, and the walls of the left side are also hinged. Each half includes shelves that are pivotally connected thereto. Once the lower left and right walls, the upper left and right walls and the lower and upper shelves are housed, the upper half rotates over the lower half supported on the hinged connection existing between the lower and upper left walls and the hinged join existing between the lower and upper right walls, thereby the display unit is folding in two parts.

11 Claims, 11 Drawing Sheets

(56) References Cited

U.S. PATENT DOCUMENTS

| | | | | |
|---|---|---|---|---|
| 2,442,154 | A * | 5/1948 | Vunovich | 312/262 |
| 3,331,514 | A * | 7/1967 | Bruynzeel | 108/109 |
| 3,602,388 | A * | 8/1971 | Hurkamp | 220/1.5 |
| 4,582,003 | A * | 4/1986 | Valero | 108/179 |
| 5,193,466 | A | 3/1993 | Eder | |
| 5,775,034 | A * | 7/1998 | Logue | 52/36.1 |
| 8,113,605 | B2 * | 2/2012 | Ceballos-Godefroy | 312/262 |
| 8,444,232 | B2 * | 5/2013 | Ceballos-Godefroy | 312/114 |
| 2003/0085640 | A1 | 5/2003 | Chan | |
| 2011/0042910 | A1 * | 2/2011 | Ceballos-Godefroy | 280/42 |

FOREIGN PATENT DOCUMENTS

| | | | | |
|---|---|---|---|---|
| WO | WO 2008062286 | A2 * | 5/2008 | A47B 31/04 |
| WO | 2008072088 | A1 | 6/2008 | |
| WO | 2008096266 | A1 | 8/2008 | |

* cited by examiner

FOLDABLE DISPLAY UNIT

FIELD OF THE INVENTION

The present invention relates to techniques employed in the manufacture and design of furniture, showcases and counters used in places known as "points of sale", where products and services are offered to the public, and, in particular, the invention relates to a foldable display unit.

BACKGROUND OF THE INVENTION

In many places where public gather for the acquisition and exposure of products and services, such as fairs, conventions, information centers and so on, there is a need to use furniture, counters and showcases, in order to approach the public to the suppliers and present their products to them. In this regard, there is an important variety of such furniture, e.g. wooden-made, metallic, furnished with shelves and partitions; in general terms, though, they are bulky, difficult to handle and transport thereof results in hardships since they take up a lot of space.

One art-known solution to such problems has involved the creation of carton foldable furniture and counters. Nevertheless, their structural rigidity is poor, so that heavy things may not be placed on them; furthermore, it is impossible for one person to lean thereon. An example of a carton showcase is disclosed in European Patent No EP 0 575 275 A1. In addition, this type of carton-made furniture lacks of an outstanding aesthetical appearance, which is an important factor to achieve a commercial impact of the product or service being offered.

In this sense, there is other type of furniture very used in points of sale as the showcases and counters, of which, foldable versions have been designed which are very practical and compact, some examples thereof are disclosed in Mexican Patents 212,227; 225,710 as well as in International Application No. PCT/IB2005/002083. In addition, in Mexican Patent No. 233,812 of the same inventor as the instant application, it is disclosed a foldable showcase having shelves or tables, this showcase is essentially divided in two halves, of which, the second half is folded over the first half in order to achieve the folded position of the showcase, however. The showcase of Mexican Patent No. 233,812 lacks of transparent compartments as the showcases require.

Moreover, the furniture and counters made of cardboard as well as the showcase mentioned in the previous paragraph are far away to satisfy the functions of the showcases, in which, the products should be stored in transparent and restricted access compartments either for safe reasons or make the products more attractive. As it may be expected, the compartments of the showcases should be fabricated of materials such as glass, polycarbonate or transparent acrylic sheets.

In addition, in the showcases, it is preferred that the compartments allow to observe the products contained therein from many observation angles, moreover, the compartments should have an acceptable internal space in order to place many kind of products therein. Taking the above into consideration, it would be desirable to have a low weight foldable showcase, in which the compartments have an ample inner capacity, however the design thereof should be that allows the showcase to be folded in order to have a reduced space once it is stored.

In the International Patent Application No. PCT/IB2007/004211, it is disclosed a foldable showcase, in which the compartments of said showcase protrude backwards of the same and form a parallelepiped. In the showcase, the exhibition space is small in comparison with all the size of the showcase; in fact, this showcase requires a base for providing stability.

Therefore, it is required new exhibitors, wherein the exhibition space can be wide as possible in order to observe the objects from many angles, and, when the exhibitor is not occupied the same can be easily demounted and folded.

SUMMARY OF THE INVENTION

Pursuant to the above, the purpose herein has been to overcome the drawbacks of the prior art showcases, developing a foldable display unit, which comprises is association a lower half; a lower left wall hingendly connected to the lower half, in which the lower left wall is housed; a lower right wall hingendly connected to the lower half, in which the lower right wall is housed; at least one lower shelf pivotally connected to the lower half, said at least one lower shelf has an "use position" in which it is mounted to one or both lower left and/or right walls; said at least one lower shelf also having a "folded position" where it is housed in the lower half.

In a similar manner with respect to the lower half, the display unit of the present invention also comprises an upper half that is supported on the lower half. To the upper half it is hingendly connected an upper left wall, which is also hingendly connected to lower left wall; the upper left wall is housed in the upper half. Another element of the present invention is an upper right wall hingendly connected to the upper half and hingendly connected to lower right wall; the upper right wall may be housed in the upper half.

Finally, another element of the foldable display unit is at least one upper shelf pivotally connected to the upper half, the upper shelf has an "use position" in which it is mounted to one or both upper left and/or right walls; said at least one upper shelf also having a "folded position" where it is housed in the upper half.

In order to fold the display unit, the lower left and right walls, the upper left and right walls and said at least one lower and upper shelves are housed; then the upper half rotates over the lower half supported on i) the hinged connection existing between the lower left wall and the upper left wall and ii) the hinged connection existing between the lower right wall and the upper right wall, so that the foldable display unit is folding in two parts.

In one embodiment of the invention, each of said lower left and right walls includes a lower door hingendly connected thereto, wherein the respective lower door is housed into the lower left wall or the lower right wall to which it is connected.

In a similar manner, each of said upper left and right walls includes an upper door hingendly connected thereto, wherein the respective upper door is housed into the upper left wall or the upper right wall to which it is connected.

In another preferred embodiment, the foldable display unit comprises means for locking the doors provided in the walls of the upper half or the lower half.

In a further embodiment, the foldable display unit comprises means for fixing the lower shelf to the lower half in order to maintain the "folded position" of the lower shelf. In addition, the foldable display unit also comprises means for fixing the upper shelf to the upper half in order to maintain the "folded position" of the upper shelf in the upper half.

More particularly, the lower and upper halves; the right and left walls of the upper half or the lower half, as well as the lower and upper right and left doors comprises a frame to which a plate is mounted, the plate is transparent in order to appreciate the content of the foldable display from different vision angles.

The structural relationship among the different elements of the preset invention allows building a resistant foldable display unit having a wide surface formed by the shelves in order to show the articles; in addition the foldable display unit is capable of being folded in a compact manner.

BRIEF DESCRIPTION OF THE DRAWINGS

Novel aspects featured by the present invention shall be set forth in connection with the appended claims. Nevertheless, the invention itself shall be better understood regarding its structure and function, as well as other objects and advantages of the same, with the following detailed description of a preferred embodiment thereof, when read in conjunction with the appended figures, in which

DETAILED DESCRIPTION OF THE PREFERRED EMBODIMENT OF THE INVENTION

Figure 1:
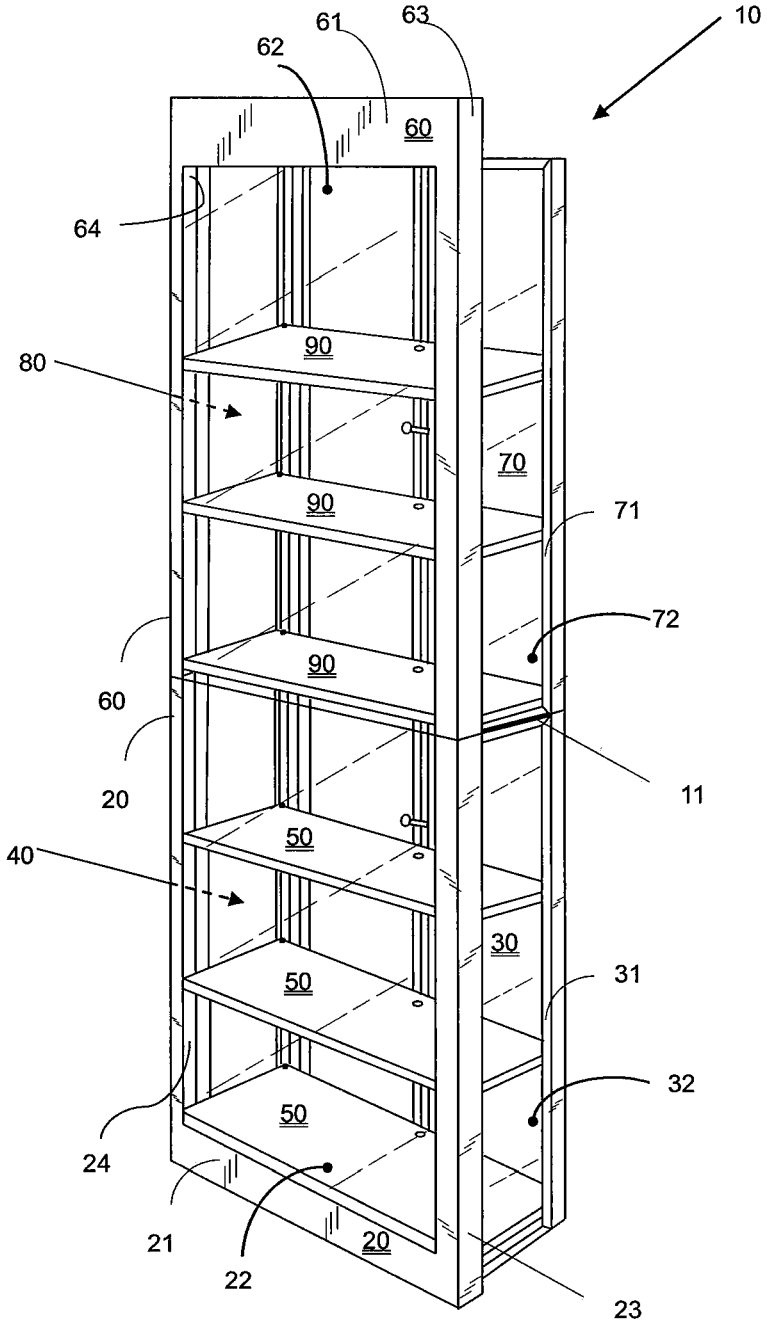
FIG. 1 is a frontal and left side perspective view of a foldable display unit built in accordance with a preferred embodiment of the present invention, the foldable display unit being in a "stand up" position.
Figure 2:
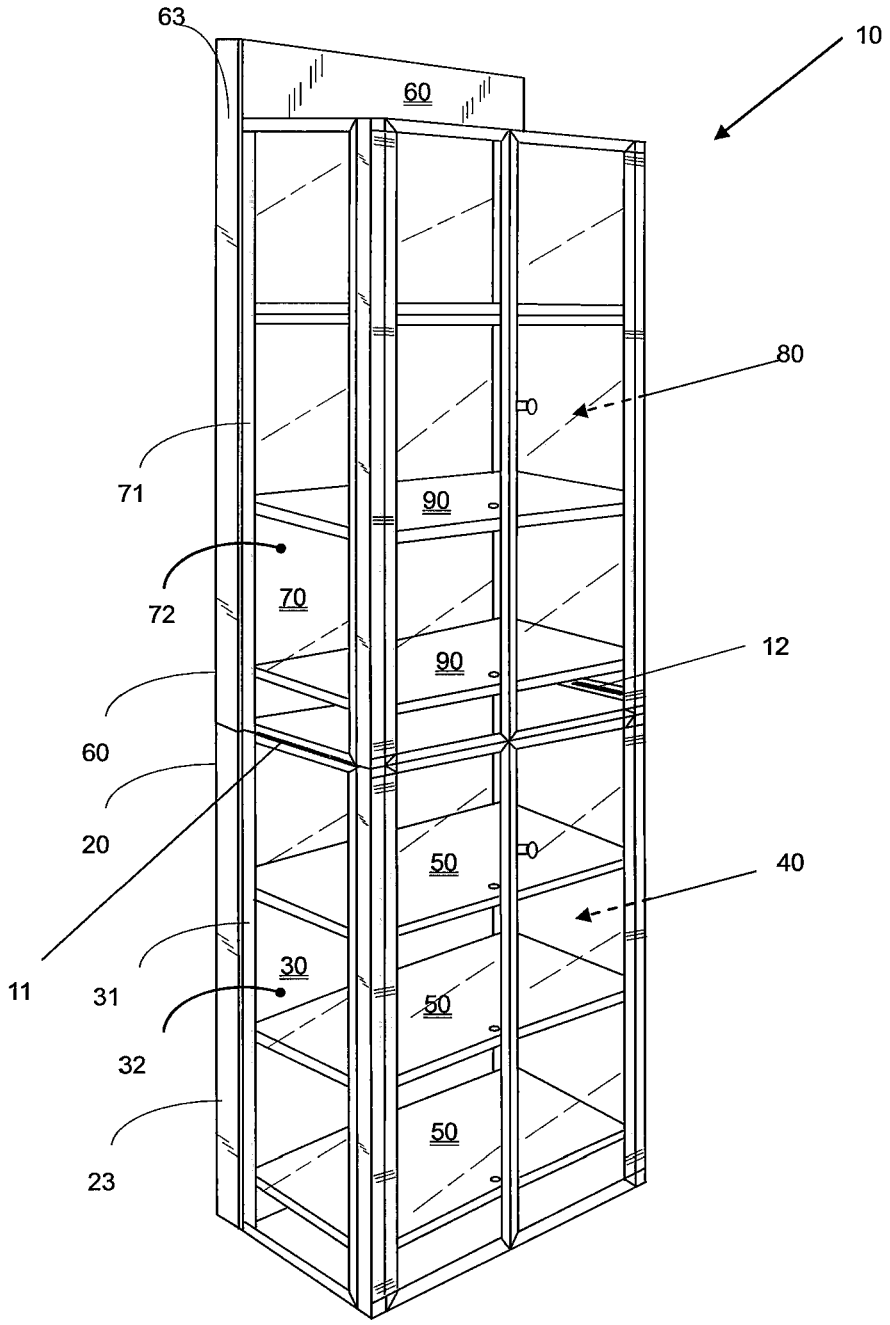
FIG. 2 is a rear and left perspective view of the foldable display unit shown in FIG. 1.
Figure 3:
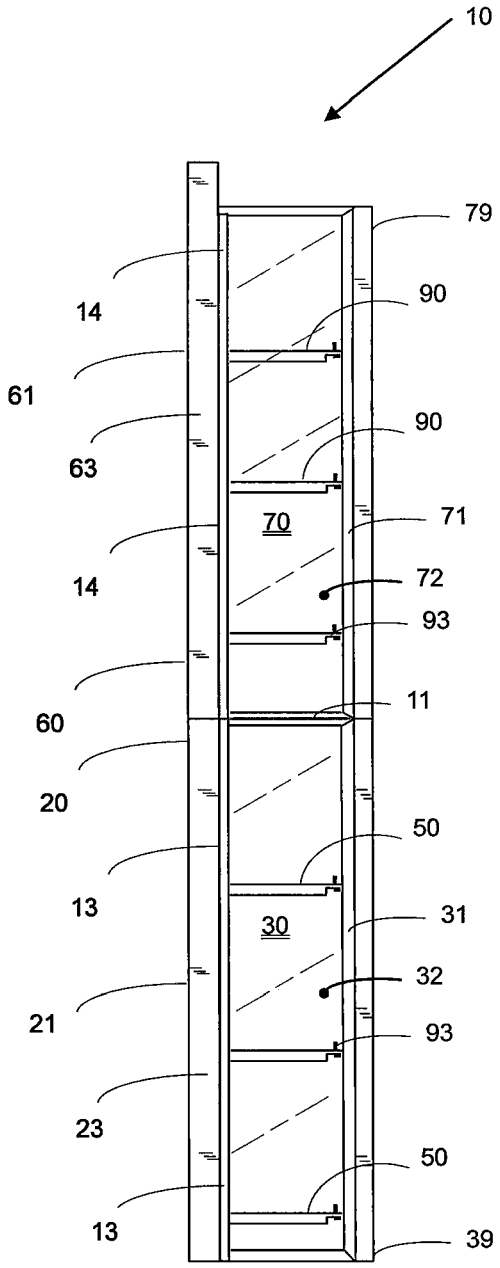
FIG. 3 is a left side view of the foldable display unit of FIG. 1.

With reference to the accompanying drawings and more specifically, to FIGS. 1 to 3 thereof, it is shown a foldable display unit 10, built in accordance with a preferred embodiment of the present invention, this embodiment should be considered illustrative and not restrictive of the present invention.

The foldable display unit of the preferred embodiment as shown in FIGS. 1 to 3, is in a "stand up" position, in which the foldable display unit is basically divided in two clearly distinguishable halves that are a lower half 20 supporting an upper half 60.

In the lower half 20, there is provided a lower left wall 30 hingendly connected to the lower half 20, the wall may be housed therein. On the opposite side of the foldable display unit 10, that is to say the right side, it can be observed a lower left wall 40 hingendly connected to the lower half 20 that houses the left wall.

Inside the lower half 20, there are provided lower shelves 50, each of them being pivotally joined to the lower half, each lower shelf 50 has a "use" position as it shown in FIGS. 1 to 3, that is to say a substantially horizontal position, in which each lower shelf 50 is mounted to one or both the lower right and left walls 30 and 40 with the purpose that, in this position, each lower shelf 50 may be firm for supporting the weight of the articles placed thereon. In addition, each lower shelf 50 also has a "folded" position, in which it is housed in the lower half 20.

Moreover, in FIGS. 1 to 3, it is observed that the upper half 60 is supported on the lower half 20. To the upper half 60, there is hingendly connected an upper left wall 70, which, in its lowermost part, is also hingendly connected to the lower left wall 30 by means of a plastic hinge 11.

Another element of the foldable display 10 unit is an upper right wall 80 hingendly connected to the upper half 60 and hingendly connected, in its lowermost part, to the lower right wall 40 by means of a plastic hinge 12.

Finally, there are also observed a plurality of upper shelves 90, each of them is pivotally connected to the upper half 60, each upper shelf 90 has an "use" position that is a substantially horizontal position, as it is shown in FIGS. 1 to 3, in this position each upper shelf 90 is mounted to one or both of the upper left and right walls 70 and 80. In addition, each upper shelf 90 has a "folded" position, in which it is housed in the upper half 60 as it will be lately disclosed.

As it can be observed, the inside of the foldable display unit 10 is visible, for this feature, in the embodiment that is disclosed, the lower half 20 comprises a frame 21 in which a plate 22 is mounted. In order to allow the lower half 20 house the lower left and right walls 30 and 40, the lower half also comprises a left flange 23 and a right flange 24 both protruding backwards of the frame 21, by which volume is obtained in the lower half 20 that protects the elements that are housed therein.

Likewise, the upper half 60 comprises a frame 61, to which a plate 62 is mounted, the upper half has a left flange 63 and a right flange 64 protruding backwards of the frame in order to provide volume to the upper half 60 that allows housing the upper shelves 90 as well as the upper left and right walls 70 and 80.

Regarding the lower left wall 30, it can be mentioned that the same comprises a frame 31 to which a transparent plate 32 is mounted. As it has been previously mentioned, the lower left wall 30 is hingendly connected to the upper left wall 70 by means of a hinge 11. The upper left wall also comprises a frame 71 and a plate 72.

In a similar manner, the lower right wall 40 and the upper right wall 80 are built by a system comprising a frame and a plate, the last being preferably transparent and is mounted to the frame, said walls are connected each to the other by means of a plastic hinge 12 that has a key role in order to fold the foldable display unit 10.

Figure 4:
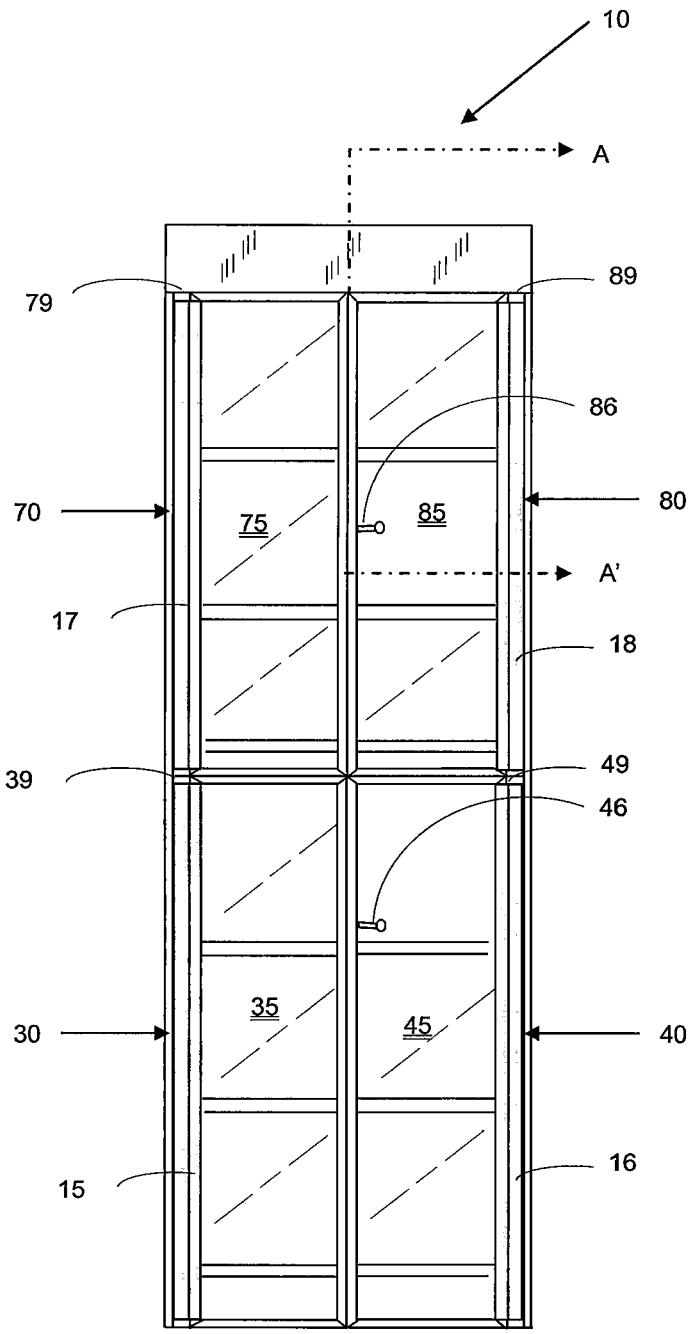
FIG. 4 is a rear view of the foldable display unit of FIG. 1.

Now, special reference is made to FIG. 3, in order to mention that the lower left wall 30 is hingendly connected to the lower half 20 by means of a plastic hinge 13. In a similar manner, the upper left wall 70 is hingendly connected to the upper half 60 by means of the plastic hinge 14. In FIG. 4, it is observed in detail the manner in which the lower left wall 30 is connected to the upper left wall 70 by means of the hinge 11, that is located between the walls 30 and 70 of the left side.

With regard to the above, it is worth mentioning that at the opposite side of the display unit, the lower right door 40, the upper right wall 80, the lower half 20 and the upper half 60 are connected and have an identical structural relationship with respect to the equivalent parts of the left side of the foldable display unit 10 as it was described in the previous paragraph. In addition, it can be observed supports 93 mounted to the walls 30 and 70 of the left side for supporting the upper and lower shelves 50 and 90.

With the purpose of providing stability to the display unit 10, the lower left wall includes a lower rear post 39 joined to the frame 31. In a similar manner, the upper left wall 70 includes an upper rear post 79 attached to the frame 71. The upper post 79 is supported on the lower post 39.

Now, reference is made to FIG. 4, that shows a rear view of the display unit 10, in this figure it may be observed that the display unit 10 is closed by means of the lower left and right doors 35 and 45 as well as the upper left and right doors 75 and 85, of them, the lower left door 35 is hingendly connected to the lower left wall 30 by means of the plastic hinge 15 running over the lower rear post 39. In a similar manner, the lower right door 45 is hingendly connected to the lower right wall 40 by means of the hinge 16 that runs over a rear right post 49 connected to the frame of the lower right wall 40.

At the upper part of the display unit 10, the upper left door 75 is connected to the upper left wall 70 by means of the hinge 17 that runs over the upper rear post 79, thus at the opposite side of the display unit 10, the upper right door 85 is hingendly connected to the upper right wall 80 by means of the plastic hinge 18 that runs over an upper rear post 89.

The lower doors 35 and 45 are locked each to the other by locking means that in the embodiment that is disclosed comprises a hook lock 46 at the lower right door, while in the upper part of the display unit 10, it is provided a hook lock 86 located in the upper right door 85 in order to keep the upper left and right doors 75 and 85 closed.

Figure 5:
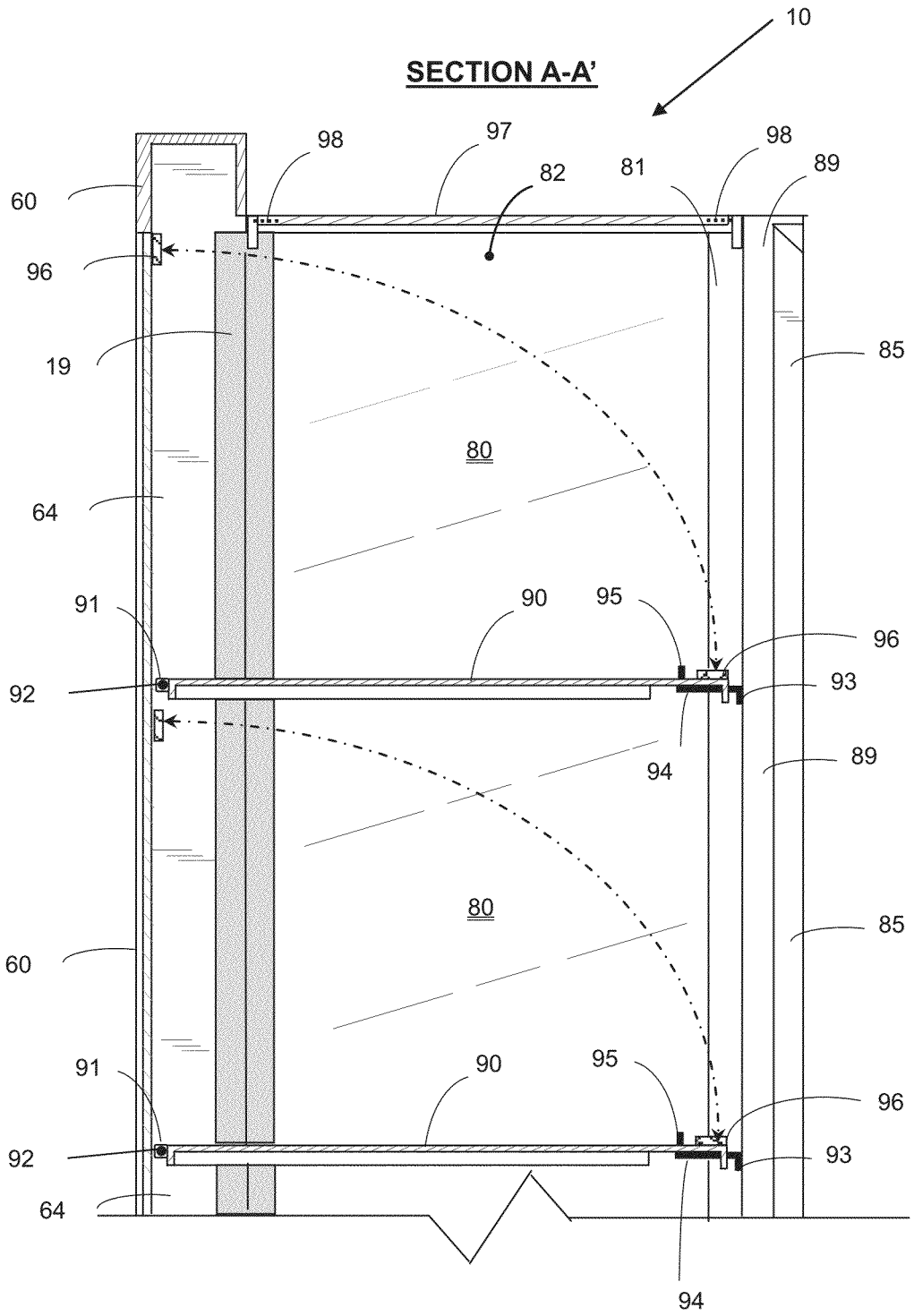
FIG. 5 is a cross section view taken along the line A-A' of the upper half of the foldable display unit of FIG. 1.

On the other hand, reference is made to FIG. 5 in order to explain how the shelves 90 are mounted in its "use" position", as it has been previously disclosed each upper shelf 90 is pivotally mounted to the upper half 60, for this purpose in the present embodiment, each upper shelve includes an ear 91 that is located at the right side of the shelf 90 and an axis 92 that crosses trough the ear 91 to be inserted in the upper half 60, more specifically, the axis is inserted in the right flange 64.

Each shelve 90 is supported to the upper right wall 80 by means of a support 93 that is attached to the upper right wall 80 and includes a base 94 and a rod 95 that crosses the shelf 90, so that the shelve is supported. It is worth mentioning that at the opposite side of the display unit 10, that is to say, at the left side, the shelve 90 is also similarly mounted by means of supports 93 joined to the upper left wall.

FIG. 5 is also helpful in order to view the means for fixing the shelf in its "folded" position, said means in the embodiment that is disclosed are cooperating portions of hooks and fibers (Velcro®) 96 provided on each shelf 90 as well as on the upper half 60, so that, when the shelf 90 is raised and rotated on the axis 92 the cooperating portions of fibers and hooks 96 matches in order to fix the shelves in its "folded" position that is substantiality vertical.

FIG. 5 also helps to appreciate the construction of the right upper wall 80 comprising the frame 81 to which a transparent plate 82 is attached as well as it is observed the upper rear post 89 that provides stability to the display unit 10 at its rear part. In addition, a side of the upper right door 85 can be observed in FIG. 5.

In this sense, it is worth indicating that in the lower part of the display unit 10 there is an identical structural relationship for the lower shelves, that is to say, they are pivotally connected to the lower half, and in its "use" position, they are supported by supports each including a base and a rod that crosses the lower shelve, the supports are provided on the lower left and right doors. In addition, the lower shelves as well as the lower half have cooperation portions of fibers and hooks (Velcro®) in order to keep the lower shelves fixed when they are in their "folded" position.

Finally, in FIG. 5, it can be observed that the display unit has a roof 97 pivotally mounted to the upper right wall 80 in order to close the display unit 10 at its uppermost part, the roof 97 is mounted by means of an axis 98 that crosses the upper right wall 80 and the roof 97.

Figure 6:
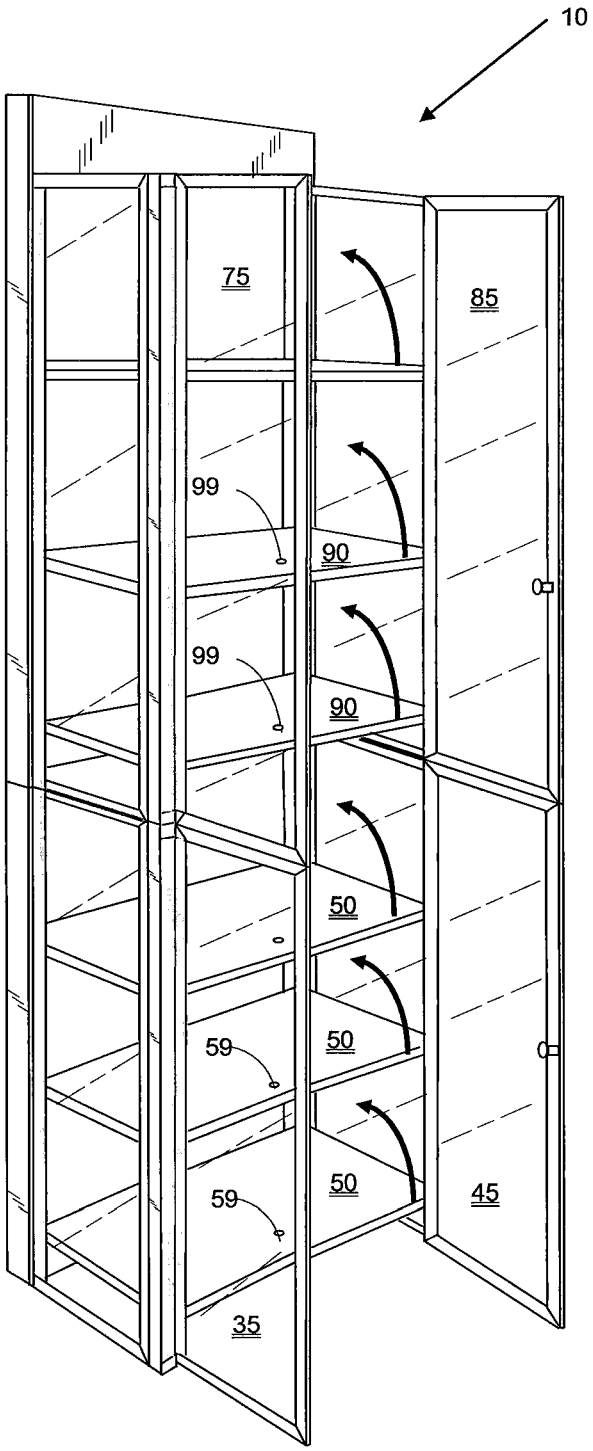
FIG. 6 is a rear perspective view of the foldable display unit of FIG. 2 having its doors open.

Now, with the aid of the remaining figures it will be disclosed the manner in which the display unit is folded. First, in FIG. 6 the upper left and right doors 75 and 85 are open; while in the lower part of the display unit the lower left and right doors 35 and 85 are open too in order to have access to the inside of the display unit 10, so that the upper and lower shelves 50 and 90 may be raised and rotated in order to be moved from their "use" position to their "folded" position, each of the shelves 50 and 90 has a hole 59 or 99 for introducing a finger in order to be raised; and when the shelves are housed, the hole allows pulling each upper or lower shelf in order to disengage the cooperation portions of Velcro®. Once the shelves are raised, the display unit reaches the position illustrated in FIG. 7.

Figure 7:
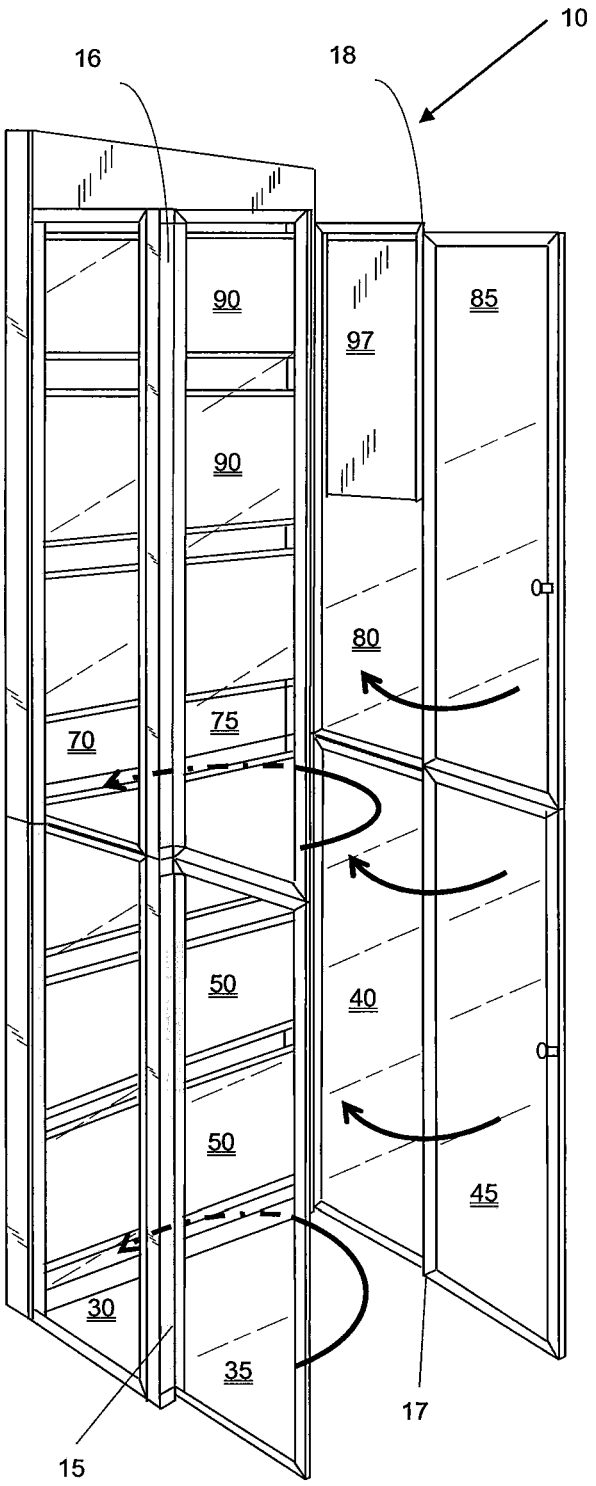
FIG. 7 is a rear perspective view of the foldable display unit shown in FIG. 6 having the upper and lower shelves in their folded position.

In FIG. 7, it is also observed that the roof 97 has been demounted and is housed in the upper right wall 80. Then, the upper left and right doors 75 and 85 are housed respectively in the upper left wall 70 and the upper right wall 80 by means of a movement of about 180° based on the hinges 16 and 18.

Figure 8:
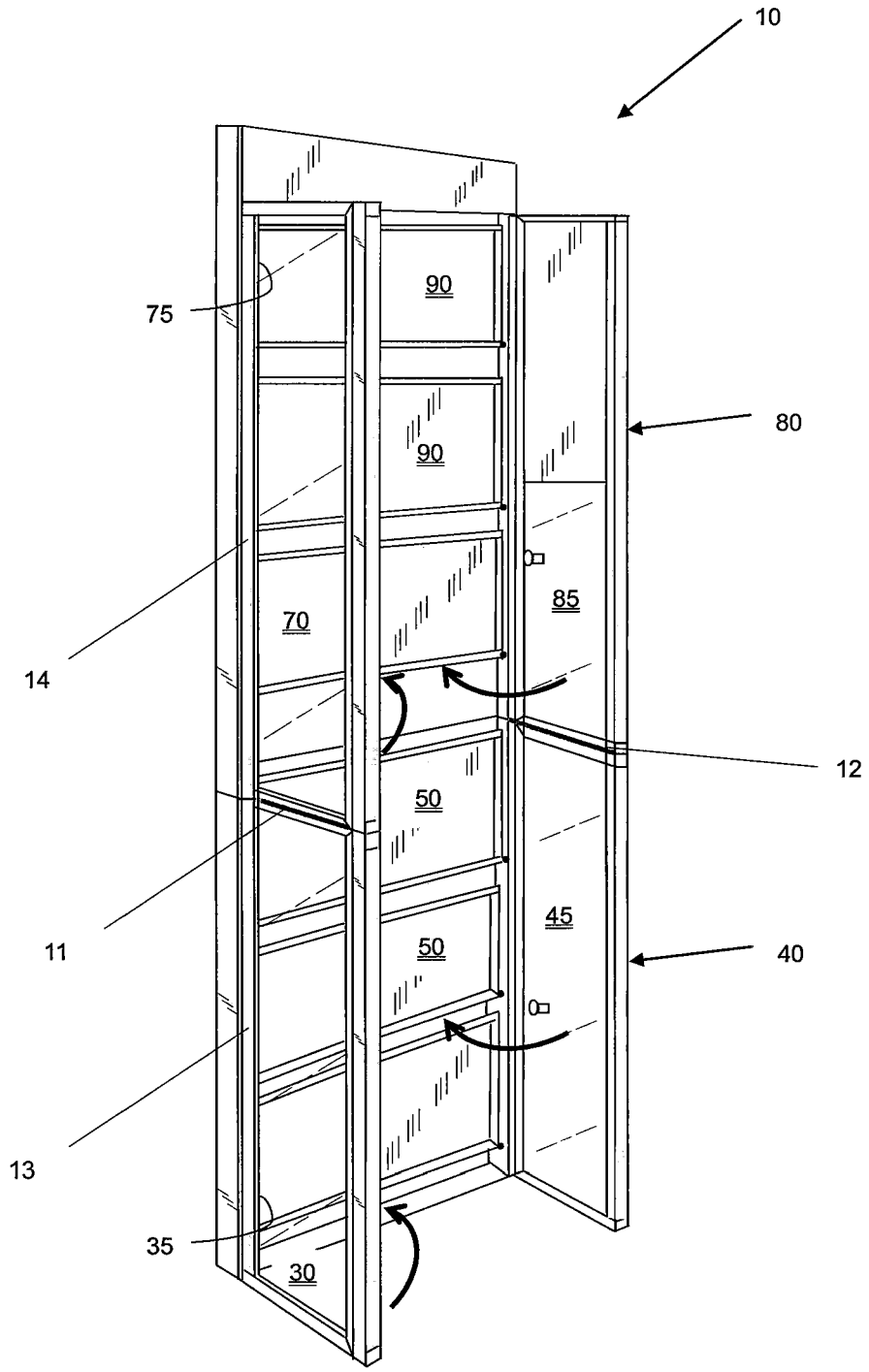
FIG. 8 is a rear perspective view of the foldable display unit shown in FIG. 7 having the doors housed in the left or right doors to which they are connected.

In a similar manner, at the lower part of the display unit 10, the lower left door 35 is housed in the lower left wall 30, while the lower right door 45 is housed in the lower right wall 40 when both are rotated about 180° on the hinges 15 and 16 up to reaching the position that is shown in FIG. 8. The size of each door 35, 45, 75 and 85 is small with respect to the wall to which is connected. In addition, it is worth mentioning that each door is independent from any other door.

Once the position of FIG. 8 has been reached, the lower left wall 30 and the upper left wall 70 (that are connected by means of the hinge 11) are rotated approximately 90° in order to be housed in the lower and upper halves 20, 60 and to be placed onto the shelves 50 and 90, the rotation is done by means of the hinges 13 and 14.

Figure 9:
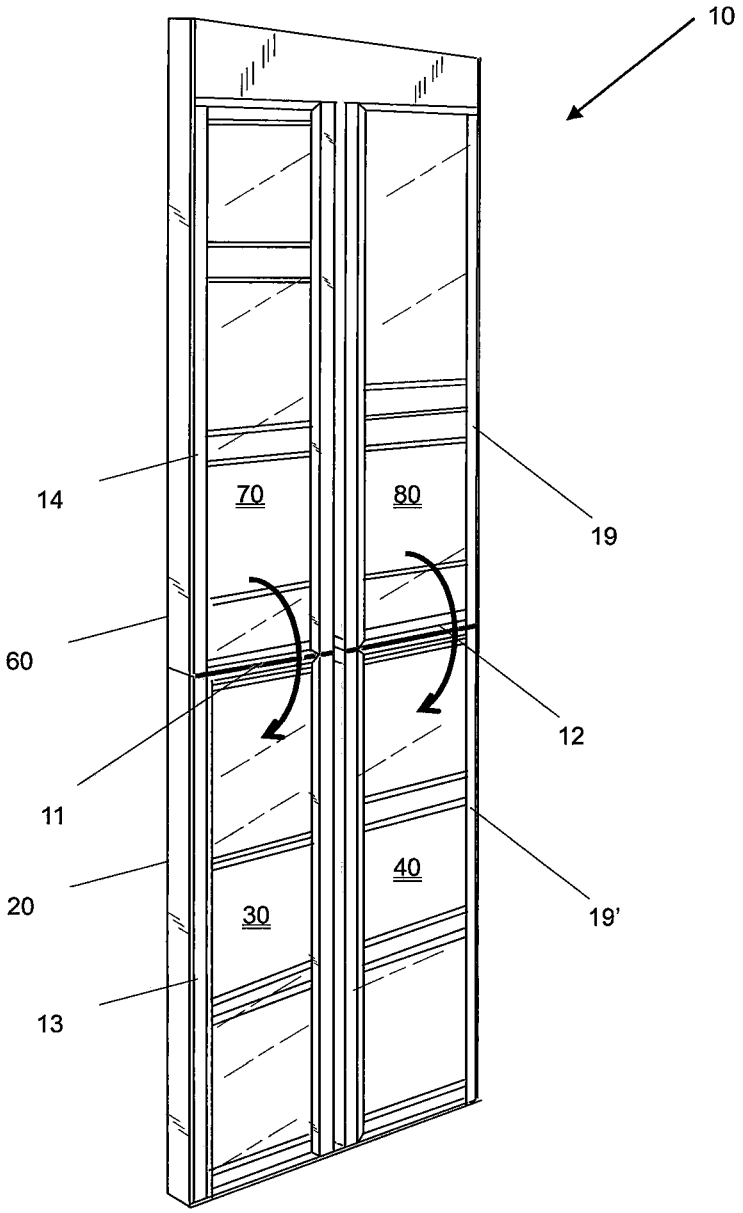
FIG. 9 is a rear perspective view of the foldable display unit shown in FIG. 8 having the lower left and right doors housed in the lower half as well as the upper left and right doors housed in the upper half.

At the opposite side of the display unit, that is to say, the right side, the lower right wall 40 and the upper right wall 80 (that are connect each to the other by means of the hinge 12) are housed in the lower half 20 and the upper half 60 when they are rotated 90° by means of the hinges 19 and 19' respectively to be placed onto the shelves 50 and 90 for reaching the position shown in FIG. 9, wherein the display unit 10 seem basically flat and enlarged. The size of each wall of the left side or the right side is small with respect to the half 20 or 60 to which is connected in order to be housed.

Figure 10:
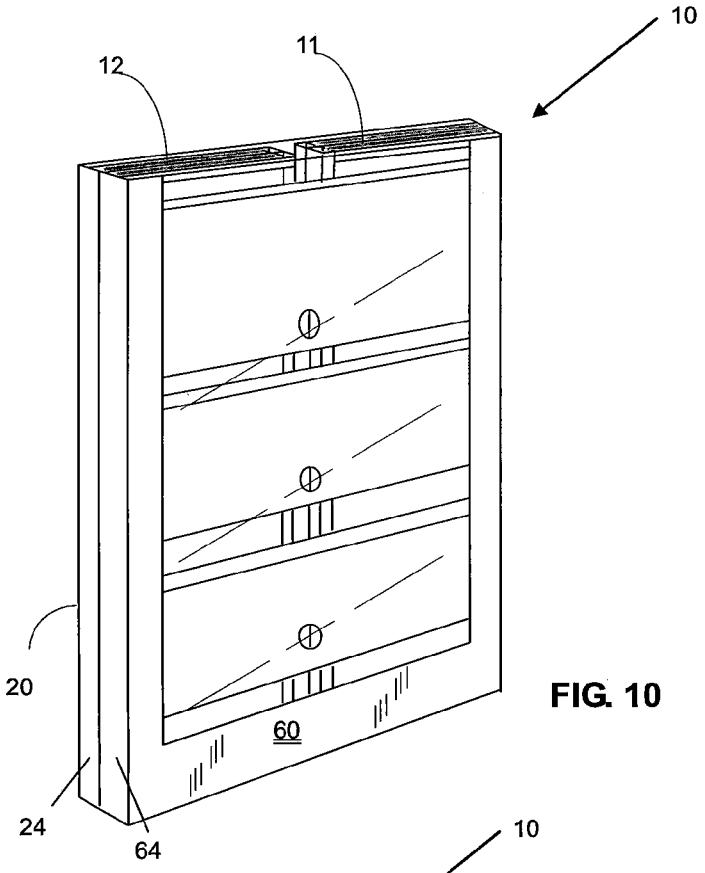
FIG. 10 is a rear perspective view of the foldable display unit of FIG. 8 being folded en two halves.
Figure 11:
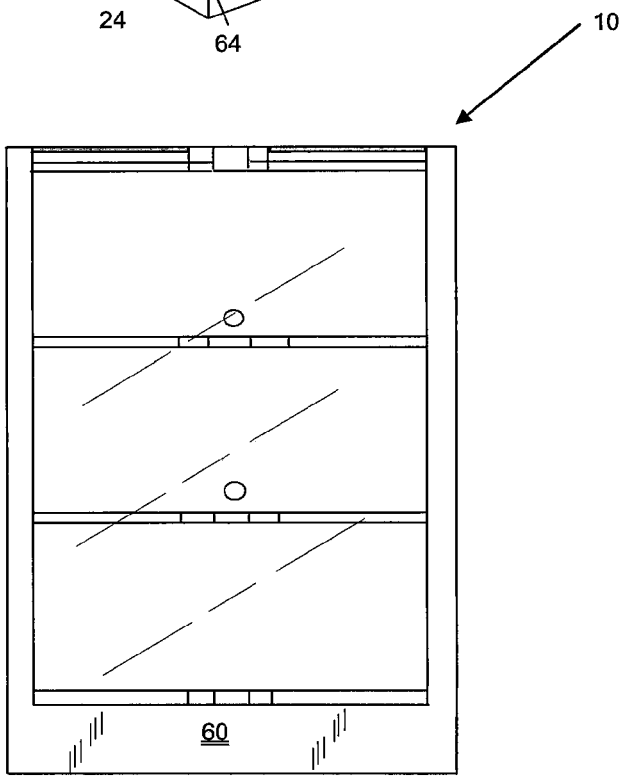
FIG. 11 is a frontal view of the foldable display unit in its folded position as shown in FIG. 10.
Figure 12:
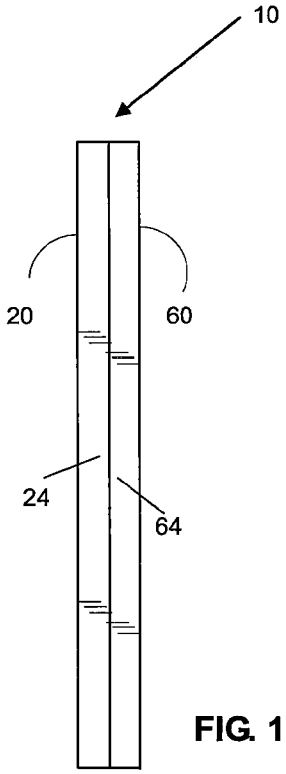
FIG. 12 is a side view of the foldable display unit in accordance with its position of FIG. 10.

Then, the upper half 60 is rotated over the lower half 20, this movement, is basically supported on i) the hinge 11 that connects the lower left wall 30 with the upper left wall 70 and on ii) the hinge 12 that connects the lower right wall 40 with the upper right door 80 in order to be folded in two halves for reaching the position shown in FIGS. 10, 11 and 12, from they it is observed that the display unit is in an extremely compact form, wherein the halves 20 and 60 house all the other elements of the display unit such as the shelves, the upper and lower walls and doors, etc. As it was previously mentioned, the lower half 20 as well as the upper half 60 include left and right flanges in order to provide volume in each half and protect the elements that are housed therein. In FIGS. 10 and 12, it is observed the right flanges 24 and 64 of the lower and upper halves respectively.

Figure 13:
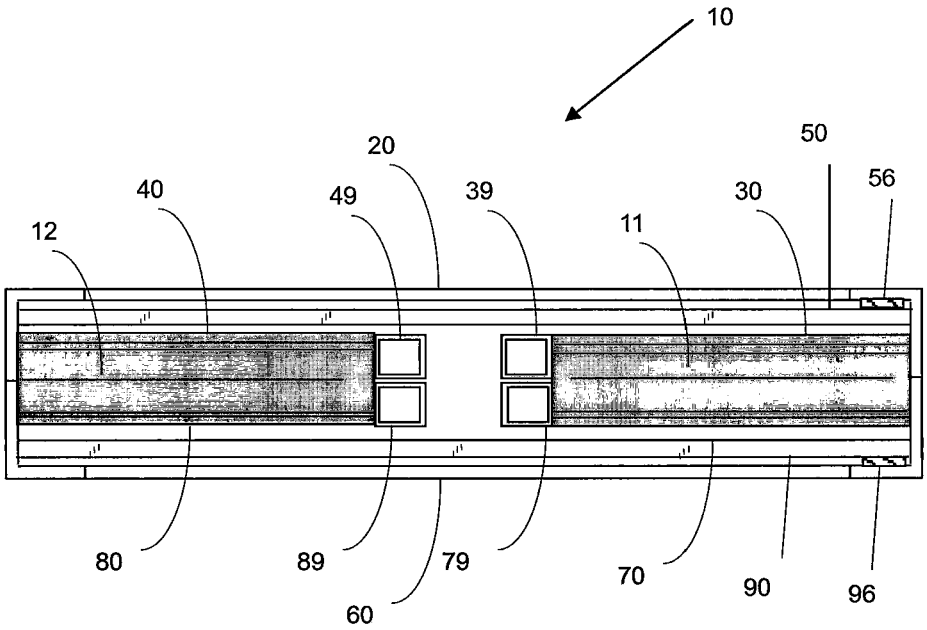
FIG. 13 is an upper plant view of the foldable display unit shown in FIG. 10.

Now, special reference is done in FIG. 13 in order to describe the plastic hinges 11 and 12, of which the hinge 11 maintains the hinged connection between the lower left wall 30 and the upper left wall 70, while the hinge 12 maintains the hinged connection between the lower right wall 40 and the upper right wall 80.

In FIG. 13, it can be also observed the Velcro® portions 96 that maintain the shelves 90 fixed to the upper half 60, in addition it can be also observed the Velcro® portions that maintain fixed the lower shelves 50 with the lower half 20. In addition it may be observed the lower and upper rear posts 39, 49, 79 and 89 that allow doors to be connected to the upper and lower left and right walls 30, 40, 70 and 80 the posts mainly provide stability to the display unit once it is its stand up.

The hinges that are used in the present invention are extremely simple since they are preferably plastic sheets adhered to the parts where a connection among the elements of the display is required, the hinges are extremely compact. Nevertheless other type of hinges may be occupied as piano hinges or plate hinges.

The display unit of the present invention is preferably made of plastic materials as PVC (Polyvinyl chloride), polycarbonate or acrylic; nevertheless other types of materials may be used with the proviso that the structural relationship among the elements of the display unit be maintained Even when a preferred embodiment of the invention has been described and exemplified, it should be stressed that several modifications of it are possible, such as the type of the hinges, the material from which the walls are made, the number of shelves etc. Therefore, this invention should not be considered as limited except for what it is required by the prior art and by the scope of the appended claims.

NUMERICAL REFERENCES OF DRAWINGS

10 Foldable display unit
- 11, 12, 13, 14, 15, 16, 17, 18, 19, 19' Hinges

20 Lower Half
- 21 Frame
- 22 Plate
- 23 Left flange
- 24 Right flange

30 Lower left wall
- 31 Frame
- 32 Plate
- 35 Lower left door
- 39 Lower rear post

40 Lower right wall
- 45 Lower right door
- 49 Lower rear post

50 Lower shelves
- 56 Fibers and hooks portions (Velcro®)
- 59 Holes

60 Upper half
- 61 Frame of the upper half
- 62 Plate
- 63 Left flange
- 64 Right flange

70 Upper left wall
- 71 Frame
- 72 Plate
- 75 Upper left door
- 79 Upper rear post

80 Upper right wall
- 81 Frame
- 82 Plate
- 85 Upper right door
- 89 Upper rear post

90 Upper shelves
- 91 Ear
- 92 Axis
- 93 Supports
- 94 Base
- 95 Rod
- 96 Fibers and hooks portions (Velcro®)
- 97 Roof
- 98 Axis

What is claimed is:

1. A foldable display unit comprising a) a lower half;

b) a lower left wall hingedly connected to the lower half, in which the lower left wall is housed;

c) a lower right wall hingedly connected to the lower half, in which the lower right wall is housed;

d) a lower left door hingedly connected to the lower left wall, in which the lower left door is housed;

e) a lower right door hingedly connected to the lower right wall, in which the lower right door is housed;

f) a plurality of lower shelves each being pivotally connected to the lower half, each lower shelf having a use position in which it is mounted to one or both the lower left wall and the lower right wall; each lower shelf also having a folded position where it is housed in the lower half;

g) an upper half supported on the lower half;

h) an upper left wall hingedly connected to the upper half and hingedly connected to the lower left wall; the upper left wall being housed in the upper half;

i) an upper right wall hingedly connected to the upper half and hingedly connected to lower right wall; the upper right wall being housed in the upper half;

j) an upper left door hingedly connected to the upper left wall, in which the upper left door is housed;

k) an upper right door hingedly connected to the upper right wall, in which said upper right door is housed;

l) a plurality of upper shelves each being pivotally connected to the upper half, each upper shelf having a use position in which it is mounted to one or both the upper left wall and the upper right wall; each upper shelf also having a folded position where it is housed in the upper half;

so that, once the lower right door, the lower left door, the upper left door, the upper right door, the lower left wall the lower right wall, the upper left wall, the upper right wall and said plurality of lower shelves and said plurality of upper shelves are housed, the upper half rotates over the lower half supported on i) the hinged connection existing between the lower left wall and the upper left wall and ii) the hinged connection existing between the lower right wall and the upper right wall, so that the display unit is folding in two parts.

2. A foldable display unit according to claim 1, further comprising means for locking the lower and upper doors.

3. A foldable display unit according to claim 1, wherein the upper left wall or the upper right wall includes a roof that is hingedly connected thereto, the roof being housed into the corresponding upper left or right wall to which it is hingedly connected and is mounted to the opposite upper wall.

4. A foldable display unit according to claim 1, further comprising supporting means that support each of the upper shelves to the upper left or right wall and support each of the lower shelves to the lower left or right wall;

wherein said supporting means includes a support mounted to the corresponding upper left or right wall or to the corresponding lower left or right wall, the support having a base provided with a rod that crosses the upper shelf or the lower shelf.

5. A foldable display unit, according to claim 1, further comprising fixing means comprising cooperating portions of fibers and hooks provided in each of the upper shelves and each of the lower shelves and in the lower half and the upper half to which the corresponding upper and lower shelf is connected.

6. A foldable display unit, according to claim 1, wherein each upper or lower shelf is provided with a hole in which a finger of a user may be inserted in order to pull the corresponding shelf from its use position to its folded position or vice versa.

7. A foldable display unit, according to claim 1, wherein the upper half and the lower half includes a frame having a left flange and a right flange that protrudes backwards of the frame; and a plate joined to the frame.

8. A foldable display unit, according to claim 7, wherein the plate is transparent or translucent.

9. A foldable display unit, according to claim 1, wherein each of the lower left or right walls and the upper left and right walls includes a frame and a plate mounted to the frame.

10. A foldable display unit, according to claim 9, wherein the plate of said walls is transparent or translucent.

11. A foldable display unit, according to claim 9, wherein the frame of the lower left or right walls and the upper left and right walls includes a rear post that provides stability to the foldable display unit.

* * * * *